US005785205A

United States Patent [19]

Kerr et al.

[11] Patent Number: 5,785,205

[45] Date of Patent: Jul. 28, 1998

[54] DISPENSER FOR DISPENSING BAG HOLDERS

[75] Inventors: Jonathan F. Kerr, Paradise Valley, Ariz.; Peter D. Dieterich, Jr., Mill Valley, Calif.

[73] Assignee: Innogrip, L.P., Sausalito, Calif.

[21] Appl. No.: 642,355

[22] Filed: May 3, 1996

[51] Int. Cl.[6] ..... B65H 3/58

[52] U.S. Cl. ..... 221/26; 221/312 A; 221/33; 221/61; 248/95

[58] Field of Search ..... 221/312 A–312 C, 221/26, 27, 33, 61; 211/49.1; 248/95, 99

[56] References Cited

U.S. PATENT DOCUMENTS

| | | | |
|---|---|---|---|
| 536,445 | 3/1895 | Rockwell | 221/312 A |
| 821,955 | 10/1959 | Horrell | 221/312 A |
| 2,985,295 | 5/1961 | Erdmann | 221/312 A |
| 3,228,555 | 1/1966 | Pinto | 221/312 A |
| 3,412,897 | 11/1968 | Slater . | |
| 3,664,546 | 5/1972 | Shelley | 221/311 |
| 4,078,261 | 3/1978 | Sinocchi . | |
| 4,172,523 | 10/1979 | Weglage . | |
| 4,182,463 | 1/1980 | Austin | 221/26 |
| 4,274,782 | 6/1981 | De Rancourt De Mimerand et al. | 221/312 A |
| 4,530,445 | 7/1985 | Decker | 221/312 A |
| 4,550,485 | 11/1985 | Killian . | |
| 4,694,554 | 9/1987 | McGrath . | |
| 5,029,926 | 7/1991 | Dieterich, Jr. . | |
| 5,058,767 | 10/1991 | Dieterich, Jr. . | |
| 5,086,921 | 2/1992 | Neff | 221/312 A |

FOREIGN PATENT DOCUMENTS

| | | | |
|---|---|---|---|
| 2425487 | 12/1975 | Germany | 221/312 A |

*Primary Examiner*—Joseph E. Valenza
*Assistant Examiner*—Khoi H. Tran
*Attorney, Agent, or Firm*—Flehr Hohbach Test Albritton & Herbert

[57] ABSTRACT

Dispensing member (200) having a guide rail (202) for dispensing an individual bag holder from a nested stack. Dispensing member (200) having a plurality of curves (208, 210, and 207) which cause a spreading or fanning out enabling bag holders (40) to be removed one by one at outfeed station (206). Bag holders (40) are loaded in clips (230) which are bound together by breakable retaining strip (232) and fed onto guide rail (202). The action of said clip (230) being pushed around curve (208) of dispensing member (200) breaks retaining strip (232), thus facilitating loading. A nib (209) prevents individual bag holders (40) from inadvertently becoming detached from dispensing member (200).

In the preferred embodiment, dispensing member (200) having curves (208, 210, and 207) which cause the nested stack of bag holders (40) to fan out at their unsupported ends.

Bag holders each having an elongated body terminating in opposed ends (50 and 52), said opposed ends each having a pair of opposed tabs (59) defining a loop receiving opening therebetween, wherein one of said loop receiving openings is interlocking with, and suspended by guide rail (202).

In other embodiments, a straight vertical dispenser (400) and a horizontally biased dispenser (500) are disclosed.

20 Claims, 6 Drawing Sheets

DISPENSER FOR DISPENSING BAG HOLDERS

TECHNICAL FIELD

This invention relates to a dispenser and method of dispensing handles or holders for hand-held articles, and more particularly, relates to a dispenser and method of dispensing attachable handles or holders for carrying plastic shopping bags having carrying loops or straps.

BACKGROUND ART

Existing bag holders to be used in this invention are described in U.S. Pat. No. 5,029,926 and U.S. Pat. No. 5,058,767 both to Dieterich, Jr. and are hereinafter referred to as "Dieterich style" bag holders. These Dieterich patents are incorporated herein in their entirety by reference.

U.S. Pat. No. 5,058,767 to Dieterich, Jr. also discloses a dispensing apparatus and method of dispensing the above bag holders. This dispenser uses a biasing means to sequentially force a number of stacked bag holders to a dispensing station where these bag holders are then removed one-by-one. The individual bag holders are removed from the dispenser through an attaching step where the carrying loop of a shopping bag is placed into the retention means in the bag holder while the bag holder remains in the dispenser. It is this fastening of the bag holder to the shopping bag carrying loop that allows the bag holder to be removed from the dispenser. This action requires manipulating the shopping bag such that its carrying loops must be placed at the top of the dispenser. When the dispenser is located at a fixed position, this will entail moving the shopping bags to the location of the dispenser for attachment of the bag holders. This moving of the shopping bags may become awkward as it may require bags being partially or fully tilted over to reach the dispenser.

Dieterich style bag holders have also been dispensed directly from pouches holding handfuls of these bag holders. These pouches are typically mounted near a store's customer checkout. The bag holders are simply tossed into these pouches and are therefore in no particular orientation with respect to one another. Not being in a nested relationship, they occupy considerably more space than is desired. In addition, as individual bag holders are pulled out of the pouch, they tend to tangle together with the opposed end tabs from one bag holder interlocking together with the opposed end tabs from another bag holder.

Various other systems exist for dispensing various retaining rings, packaging clips and other articles. For example, U.S. Pat. No. 4,550,485 to Killian and U.S. Pat. No. 4,172,523 to Weglage both describe retaining ring dispensers. U.S. Pat. No. 3,412,897 to Slater discloses a dispensing device for ball structures. Finally, U.S. Pat. No. 4,708,261 to Sinocchi and U.S. Pat. No. 4,694,554 to McGrath disclose packaging clip dispensers for dispensing clips for holding together the folded-over edges of a paperboard carton and for clamping off a tubular member, respectively. None of these inventions is, or could be, adapted to dispense Dieterich style bag holders.

Consequently, what is desired is an apparatus and method of easily dispensing existing Dieterich style bag holders which does not require physical contact to be made with the carrying loops of a shopping bag to initiate the sequentially dispensing of each individual shopping bag holder. In addition, this apparatus and method of dispensing Dieterich's bag holders should provide compact storage for the bag holders, and dispense them efficiently while presenting them in a uniform orientation. A system for separating the bag holders one from another where a single bag holder is sequentially presented for easy grasping and removal by an operator is also desired.

OBJECTS OF THE INVENTION

It is an object of the present invention to provide an apparatus and method of dispensing Dieterich style bag holders.

It is a further object of the present invention to provide a dispenser for these Dieterich style bag holders which does not use a mechanical biasing element.

It is a further object of the present invention to provide a dispenser for Dieterich style bag holders which has no moving parts.

It is a further object of the present invention to provide a dispenser for Dieterich style bag holders which provides compact storage for the bag holders.

It is a further object of the present invention to provide a dispenser for Dieterich style bag holders which dispenses the bag holders efficiently while presenting them in a uniform orientation.

It is a further object of the present invention to provide a dispenser for Dieterich style bag holders which separates the bag holders one from another such that a single bag holder is sequentially presented for easy one by one removal by an operator.

It is a further object of the present invention to provide a system for dispensing Dieterich style bag holders which does not require the carrying handle of a shopping bag to be brought to the location of the bag holder dispenser each time a bag holder is to be removed from the dispenser.

It is a further object of the present invention to provide a very simple, easy-to-use dispensing system for Dieterich style bag holders.

It is a further object of the present invention to provide a simple, very easy-to-manufacture dispensing system for Dieterich style bag holders.

It is a further object of the present invention to provide a handy and compact storage system for nested stackable Dieterich style bag holders which is easy to load, and saves space.

It is a further object of the present invention to provide a dispensing system for Dieterich style bag holders which easily connects to existing shopping bag dispenser racks, and does not interfere with shopping bag loading procedure.

It is a further object of the present invention to provide a dispensing system for Dieterich style bag holders which easily dispenses single bag holders, avoiding the problem of unintentionally dispensing more than one bag holder at a time.

It is a further object of the present invention to provide a dispensing system for Dieterich style bag holders which is easily loaded with groups of nested bag holders in a bound together form.

It is a further object of the present invention to provide a dispensing system for Dieterich style bag holders which stores the bag holders in a single plane.

Additional objects and advantages of the invention are set out in detail and will become apparent in the Best Mode of Carrying Out the Invention and the attached drawings.

DISCLOSURE OF THE INVENTION

A dispenser for plastic bag strap holders, each holder having a main U-shaped section with a pair of T-shaped end receptacles formed by bendable opposed tabs forming the spanning of T-receptacles to receive and capture bag straps comprising: (a) an elongated guide rail means for slidably mating with a mating receptacle of one end of each bag holder of a nested stack of said holders and for maintaining said stack in a single plane, (b) said guide rail having an infeed end and an outfeed end and having a substantial component of vertical orientation to cause said stack to feed by gravity from infeed to outfeed end, and with the guide rail means being curved upwardly at the outfeed, and (C) stop means at said outfeed end for stopping movement of said nested stack and to allow one by one removal of each holder.

BEST MODE FOR CARRYING OUT THE INVENTION

The present invention provides a simple and easy method and apparatus to store and dispense the stackable bag holders as described in Dieterich U.S. Pat. Nos. 5,029,929 and 5,058,767. These bag holders are formed with loop receiving openings at their opposed ends. These loop receiving openings are defined by a pair of bendable opposed tabs found at each end of the individual bag holders and are generally T-shaped. These bag holders are formed with a substantially U-shaped cross transverse section with diverging sidewalls, and can be mounted in nested relation in a stack. The prior Dieterich patents disclose a dispenser for the bag holders which used a biasing means to sequentially force a number of stacked bag holders to a dispensing station where they are then removed one-by-one. The carrying loop or plastic bag strap of a shopping bag is connected into the loop receiving opening of the particular bag holder located at the top of the dispenser. As this shopping bag is pulled away from the dispenser, the top bag holder remains attached to the shopping bag and is also removed, with another bag holder moving upwards into its position.

The present dispenser avoids the use of a moving mechanical bias in most embodiments and also allows the individual bag holders to be dispensed from a stack without requiring the carrying loop or strap of the plastic bags to be inserted in the loop receiving opening of a bag holder as each bag holder is sequentially removed from the dispenser. In addition, the present dispenser provides for easy loading and storage of bound together nested stacks of the bag holders which are gravity fed from an infeed end to an outfeed end. Should the unlikely need arise, it is additionally possible to load each of bag holders individually.

Figure 1:
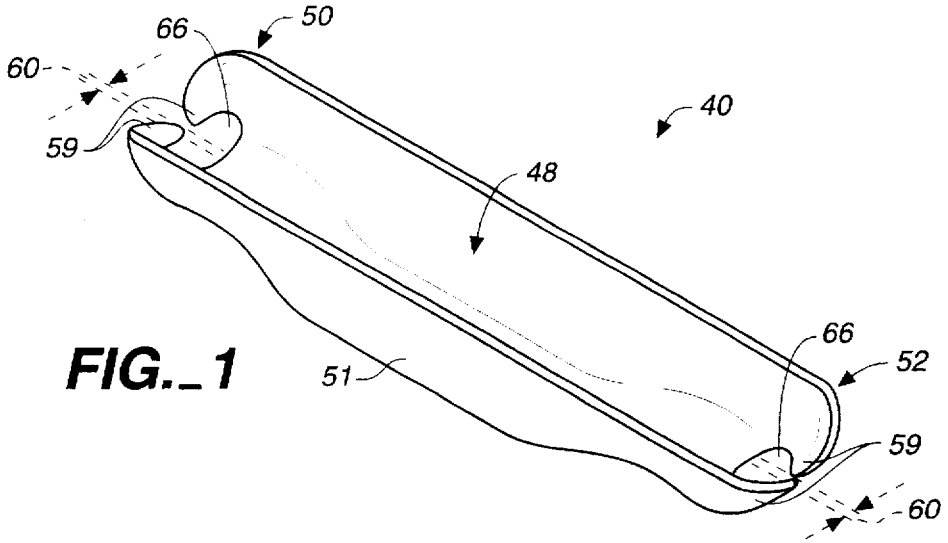
FIG. 1, is a perspective view of a Dieterich style bag holder as set out in U.S. Pat. No. 5,058,767 and U.S. Pat. No. 5,029,926, both to Dieterich, Jr.

As is first seen in FIG. 1, a Dieterich style bag holder 40 has an elongated body which terminates in opposed ends 50 and 52. Formed in an upwardly facing side of the holder body is a loop receiving channel 48, which preferably extends over the entire length of the holder. A downwardly facing side of the holder is formed with a manually engageable gripping surface, generally designated 51. A pair of opposed hook like tabs 59 define an entry passageway therebetween. Loop receiving openings 66 slidably receive handles of a shopping bag when they have passed through channel 60 and beyond tabs 59. On each of opposed ends 50 and 52 are found a pair of opposed tabs 59 defining the loop receiving opening 66 therebetween. Together, loop receiving opening 66 and channel 60 define a generally T-shaped receptacle. When in a nested stacked relationship, an overall mating receptacle is formed from a plurality of nested stack T-shaped receptacles. Each bag holder 40 further has a substantially U-shaped transverse cross section, with diverging sidewalls providing an upwardly facing channel receiving a second holder of substantially the same configuration in nested relation thereto, and a downwardly facing gripping surface. These bag holders are mounted in nested relation in a stack with their concave top side facing upwards. Further structural details of bag holder 40 is also shown in Dieterich U.S. Pat. Nos. 5,058,767 and 5,029,926 which are incorporated herein in their entirety by reference. It is to be understood that the present invention can also be used to dispense any form of bag holder having substantially similar characteristics to the Dieterich style bag holders, particularly formed with receptacle(s) at at least one end and the ability to nest in a stacked relationship.

Several preferred embodiments of the present invention are disclosed. In particular, the present invention discloses a vertically suspended curved dispenser, a direct vertical downward dispenser and a horizontally biased dispenser.

The structure and function of the vertically suspended curved dispenser will now be set forth.

Figure 2:
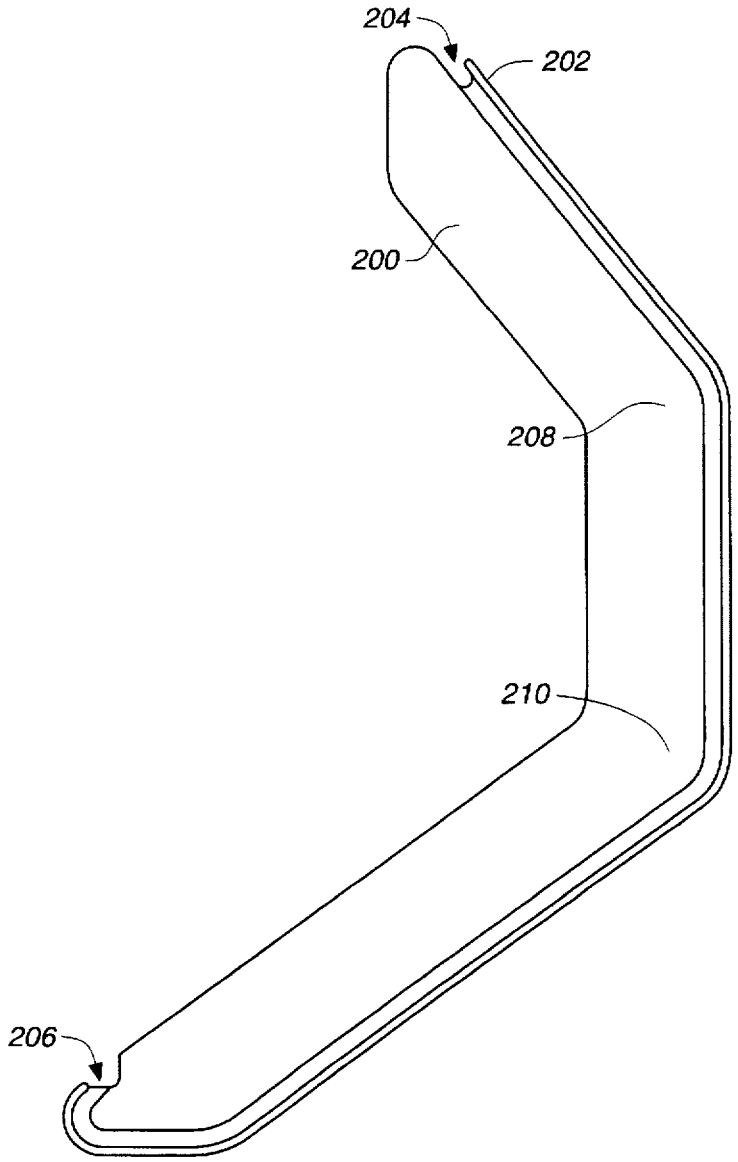
FIG. 2 is a side elevational view of a vertically suspended curved dispenser for Dieterich style bag holders formed in accordance with the present invention.

As is best seen in FIG. 2, a dispensing member 200 is constructed with a unique shape. This dispensing member is designed to be suspended vertically in the orientation as shown. To this dispensing member 200 is attached an elongated T-shaped guide rail 202 which runs substantially along the length of one side of dispensing member 200. This dispensing member has an infeed station 204 located at its top and an outfeed station 206 located near its bottom. Dispensing member 200 is generally composed of an elongated straight support sections which changes direction at curves 208 and 210. All these sections lie in a common vertical plane.

Figure 3:
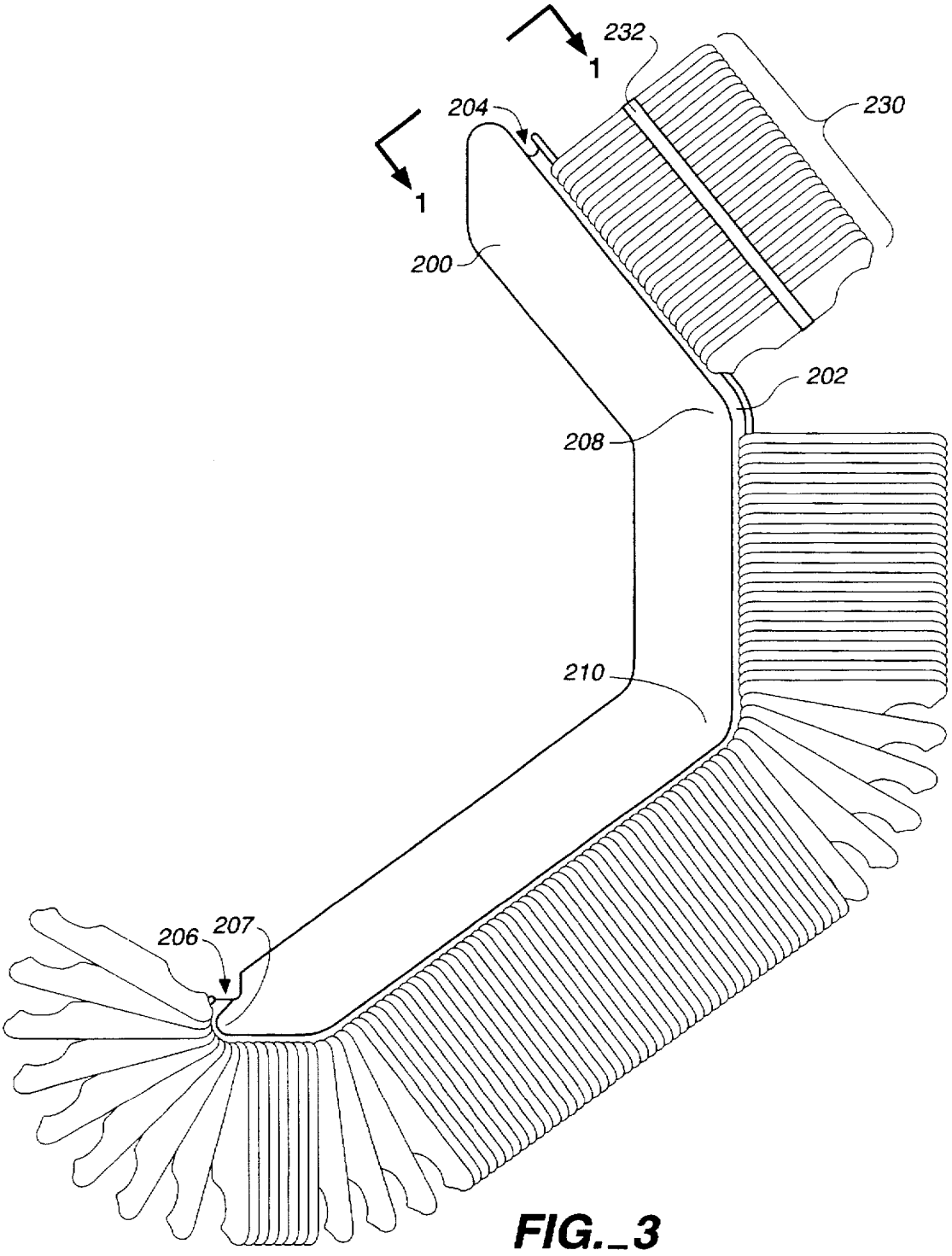
FIG. 3 is a side elevation view of a vertically suspended curved dispenser for Dieterich style bag holders having bag holders loaded thereon.
Figure 4A:
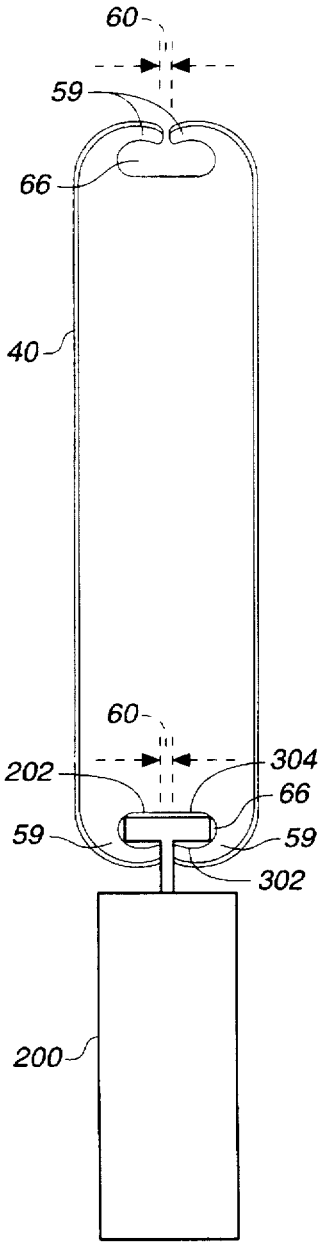
FIGS. 4A, 4B and 4C each show a downward looking view taken along line 1—1 as shown in FIG. 3, with various structural embodiments.
Figure 4B:
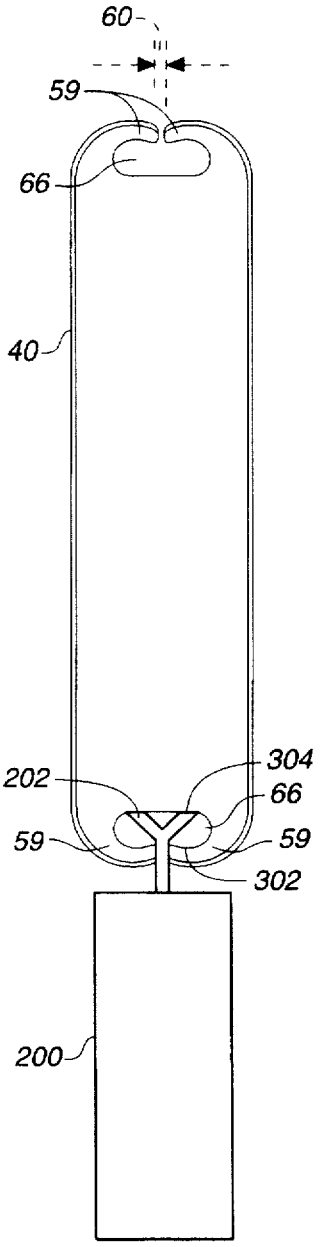
Figure 4C:
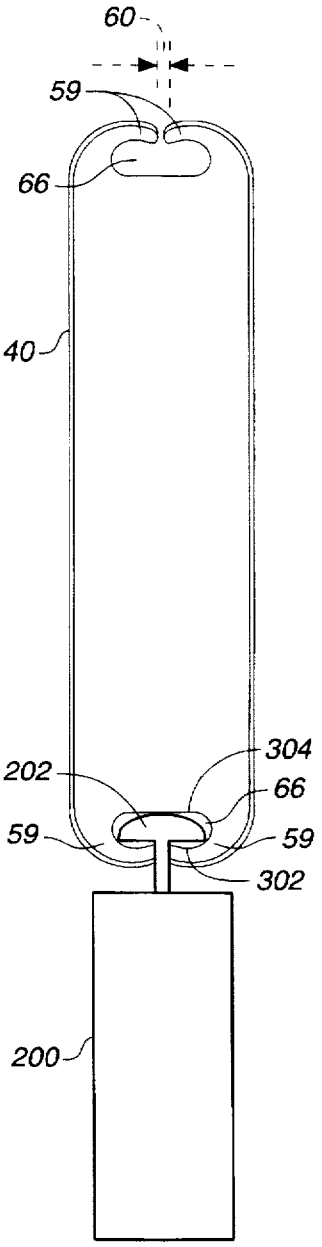

FIG. 3 shows the dispensing member 200 loaded with a plurality of Dieterich style bag holders. Bag holders are typically fastened together in clips 230 containing 50 bag holders in nested relationship with one another. These clips 230 are typically held together by a breakable or removable retaining strip of paper 232 which binds them together. These bag holder clips 230 are loaded onto infeed station 204 in the manner such that guide rail 202 matingly interengage with tabs 59 on the individual bag holders. This is best seen in FIG. 4A which shows the interlocking of guide rail 202 and opposed tabs 59. Guide rail 202 is received into the loop receiving opening 66 with the base of the T-shape of the guide rail 202 slipping through channel 60 and the cross beam of the T-shaped guide rail 202 substantially filling loop receiving opening 66 and resting against opposed tabs 59. Other shapes in addition to this T-shape could perform essentially the same function since they have the essential functional elements of a T-shape. For example, a Y-shape would also easily slide through channel 60 of the bag holders and interlock with their opposed tabs 59 while substantially filling loop receiving opening 60. FIG. 4B shows such a Y-shaped guide rail and FIG. 4C shows yet another shape of guide rail.

Clip 230 is placed onto guide rail 202 at infeed station 204. By sliding clip 230 over guide rail 202. As clip 230 moves downward to curve 208, the individual bag holders which had been resting in a nested stacked relationship, will tend to fan apart from one another when passing over curve 208. The action of these bag holders tending to fan apart at curve 208 will cause breakable retaining strip 232 to break. Accordingly, by pushing clip 230 downward on guide rail 202, an operator will be able to conveniently load the dispenser with clips of bag holders and remove the fastener holding these bag holders together, all in one simple downward loading motion.

As is best seen in FIG. 3, guide rail 202 will hold a large plurality of bag holders along its length, and therefore represents a convenient storage location for many bag holders, which does not require very frequent re-loading of bag holders. The relatively long vertical height of dispensing member 200 enables it to function as a means for storing many bag holders at a time.

Figure 5:
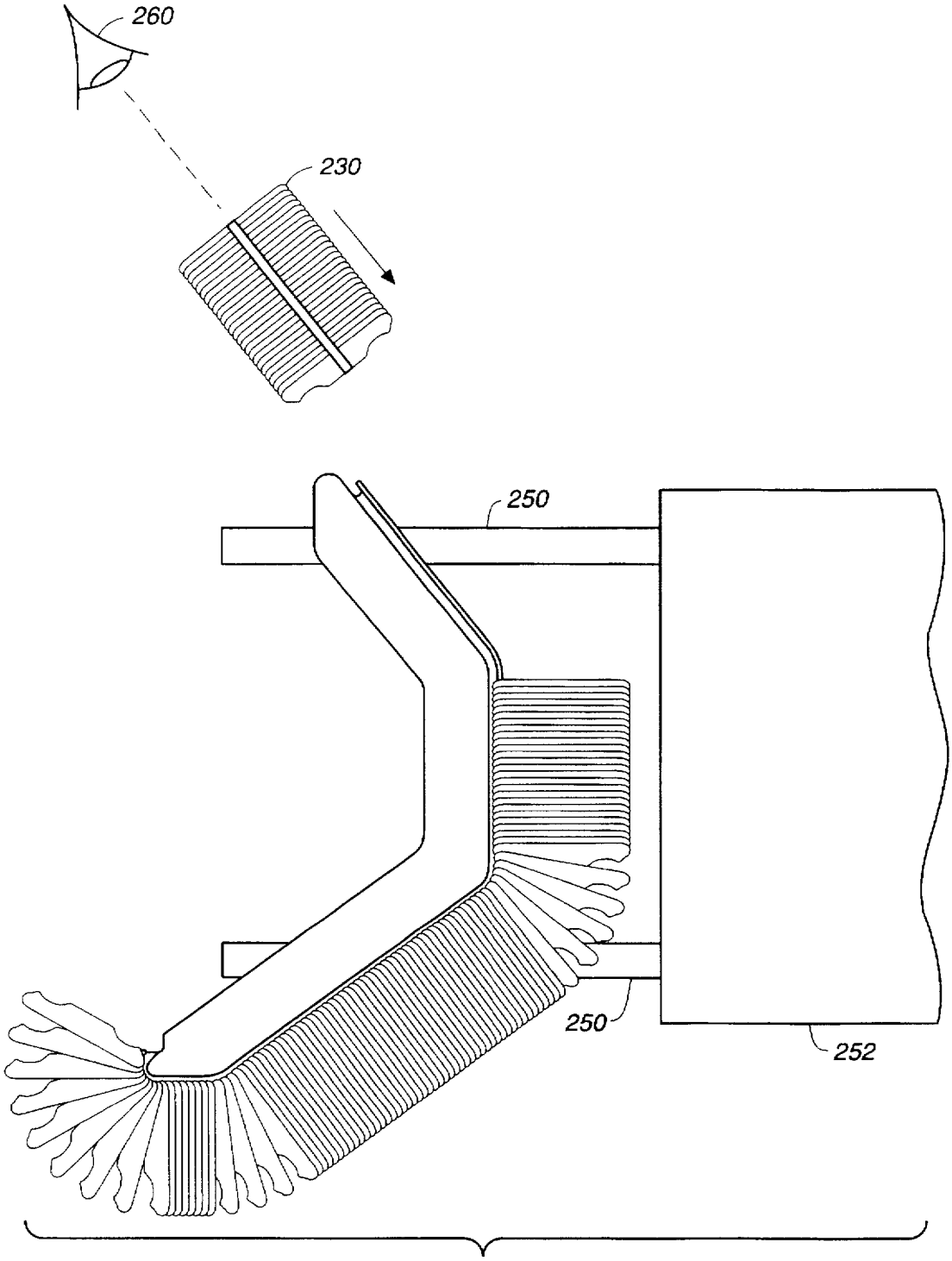
FIG. 5 is a side elevational view of the vertically suspended curved dispenser mounted to a shopping bag dispensing structure or checkout stand.

The top section of dispenser 200 is angled somewhat from the vertical so that an operator having an eye 260 can load clips 230 onto guide rail 202 while standing in front of a shopping bag dispensing structure typically found at a grocery store checkout. This particular set up can best be seen in FIG. 5 which shows a wire rack 250 mounted to the end of a grocery store checkout counter 252. Dispenser 200 is mounted in the orientation as shown such that an operator standing near the checkout counter would easily be able to look directly downwards onto guide rail 202 without having to be directly over wire rack 250, thus facilitating easy loading of a clip 230 of bag holders, from an easily viewable angle.

As is seen in FIG. 3, when loaded, the bag holders substantially fill the length of guide rail 202. The force of gravity moves the individual bag holders downwards from infeed station 204 to eventual outfeed station 206. As the individual bag holders move downward under the influence of gravity, they will tend to remain in a nested stacked planar relationship to one another along the straight portions of dispenser 200. However, at the curved locations 208, 210 and 206, the curve of the dispenser 200 when acting in conjunction with the shape of the individual bag holders, will cause the individual bag holders to separate or fan out at their outward ends as is shown by the bag holders passing around curves 210 and 206.

Large gaps form between the individual bag holders at the ends of said individual bag holders farthest from said dispensing member 200, as is shown in the diagram. It is an important property of the present invention that this separation or fanning out between individual bag holders will be widened as the radius of curvature of the guide rail 202 is tightened. This spreading out of the individual bag holders, as a nested stack of bag holders rounds a guide rail corner is accounted for by the unique shape of both the bag holders and the guide rail interlocking together. Having a main U-shaped section for a loop receiving channel 48, as shown in FIG. 1, each bag holder rests one inside the other with points of contact between the bag holders running along a roughly horizontal line midway up the bag holder's diverging side walls. When pushed together in a nested stack rounding a curve in the guide rail, the spacing between respective bag holders will remain constant only at the ends secured to the guide rail. As they round the corner, as shown in FIG. 3, the free ends of the bag holders must spread apart in a uniform manner as the angle of the points of contact between the respective bag holders will now run as a line at an angle to the previous line of contact between bag holders across each bag holder's diverging side walls.

This radius of curvature is tightest at the outfeed station 206, and particularly at point of curvature 207. Accordingly, at this location, the individual bag holders separate or fan out the farthest from one another. This separation or fanning out of the individual bag holders at the curved point 207 of the dispensing member 200 will enable individual bag holders to be quickly and easily grasped and removed from the dispensing member 200 simply by lifting bag holder upwards slightly. The separation between the individual bag holders at outfeed station 206 makes it easy for an operator to grasp one bag holder at a time.

The effect of gravity will ensure that the bag holders continue to move from downward from the infeed station 204 to the outfeed station 206. As an individual bag holders is removed from outfeed station 206, the bag holder immediately following the one removed will advance in position to the location of the removed bag holder. Accordingly, sequentially removing one bag holder at outfeed station 206 will ensure a continual flow of sequential bag holders available at this location to be dispensed. Having a number of bag holders suspended on guide rail 202, the weight of these bag holders will tend to ensure that the individual bag holders spread or fan out at outfeed station 206.

Figure 6:
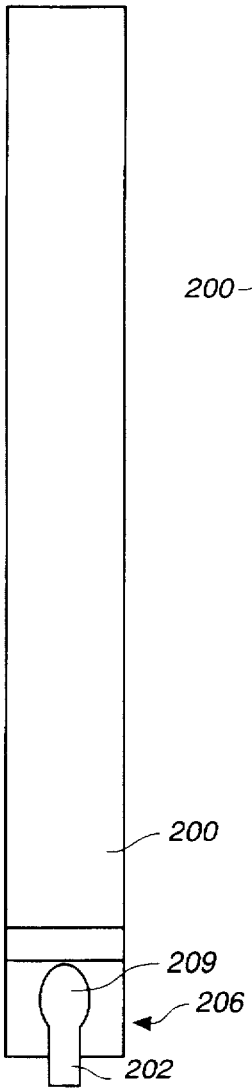
FIG. 6 is a front elevation view of the vertically suspended curved dispenser of the present invention.

Also at outfeed station 206, the guide rail 202 is widened slightly so as to form a nib 209. This nib is best seen in FIG. 6, and is designed to prevent the bag holders from sliding freely off the end of guide rail 202 at outfeed station 206. This nib ensures that the weight or loading force alone of the nested stack of bag holders on guide rail 202 is insufficient to cause the bag holders at outfeed station 206 to freely slip off the lower end of the guide rail. Alternatively, this nib 209 could be formed integral to the dispenser 200 and guide rail 202 such that an end point or nib is reached in guide rail 202 at a location where guide rail 202 is formed to curve directly into, or is fused into dispenser 200 at outfeed station 206.

As an alternative to nib 209, guide rail 202 could be constructed to run farther up the front of dispenser 200 thus ensuring the weight of the bag holders running down the back of dispenser 200 along guide rail 202 is not sufficient to push the bag holders upwards off the free end of guide rail 202 at the front of the dispenser. The effect of friction will prevent the bag holders from sliding too far up the front of the dispensing member 200 along guide rail 202.

Another important property of the present invention is the fact that the stored nested stack of bag holders are held in a uniform vertical plane. The nested relationship of the stacked bag holders, coupled with the interlocking structure between the guide rail 202 and the bag holder 40, as is best seen in FIGS. 3 and 4, allows very limited side to side movement of the bag holders with respect to the guide rail 202 due to the narrow clearances between the bag holder 40 and the T-shaped guide rail 202. Accordingly, the bag holders are maintained in the same uniform vertical plane in which straight support section of dispensing member 200 lie. Accordingly, the plane in which the bag holders are held is simply an extension of the plane in which the dispenser 200 is located. It would be possible to design guide rail 202 to veer from this uniform vertical plane, however, this would tend to separate the nested bag holders from their stacked relationship, therefore consuming more vertical space per each bag holder. Angling guide rail 202 from this uniform vertical plane at some locations, particularly at the outfeed station, would cause the nested bag holders to separate somewhat which could make the bag holders easier to grasp at these locations.

Figure 7:
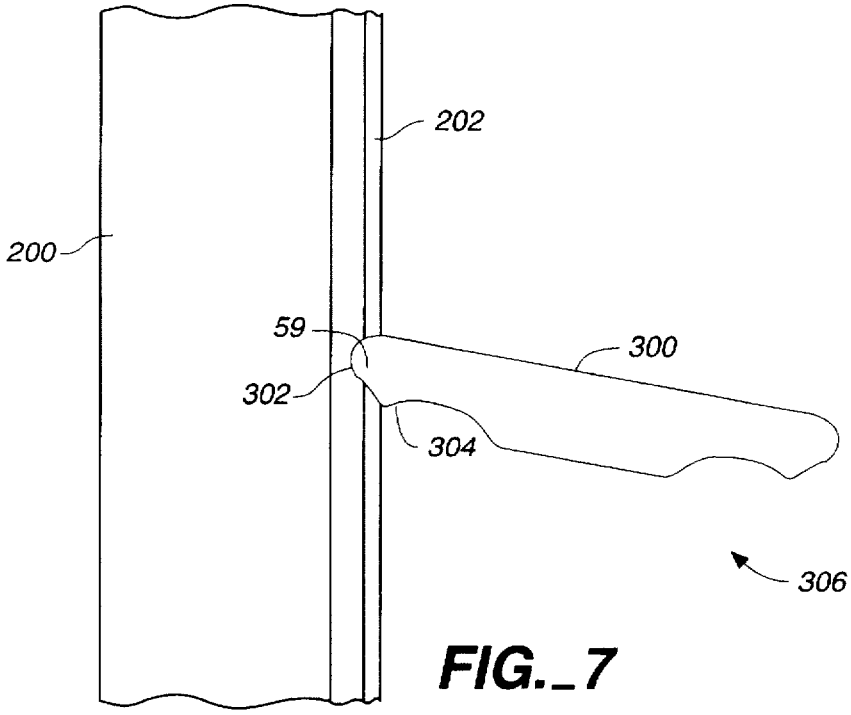
FIG. 7 is a side elevational view of a single Dieterich style bag holder as positioned on a vertically suspended guide rail.

Another important property of the bag holders used in the present invention is the fact that opposed tabs 59 are angled from the vertical, as show in FIG. 7 such that when bag holder 300 slidably mates with guide rail 202, bag holder 300 will tend to position itself nearly horizontal, being at a near perpendicular orientation to guide rail 202. This is caused by the fact that tabs 59 wrap around guide rail 202 with the bottom edge 302 of tab 59 wrapping around guide rail 202 and the bottom side 304 of bag holder 300 resting against guide rail 202. In this way, when bag holders are loaded onto guide rail 202, and the guide rail is positioned substantially vertically, the individual bag holders will tend to rest nearly perpendicular to the guide rail. Accordingly, the individual bag holders will tend to slide easily downward along the guide rail, especially when placed together in a nested stacked relationship to one another as this further minimizes the spread between the free ends of a plurality of holders when they are placed in a nested stack. This interlocking feature of the bag holders and the guide rail will tend to prevent the free end 306 of the bag holders from drooping downward, which would cause the bag holders to bind on the guide rail, and would hinder gravity feeding.

Figure 8:
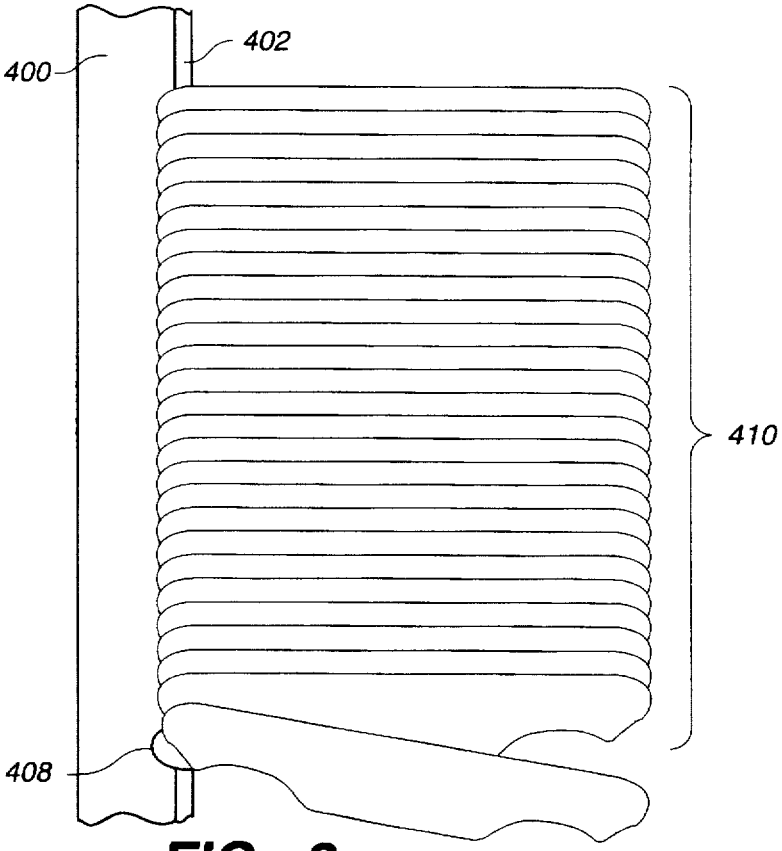
FIG. 8 is a side elevational view of an alternative dispenser for Dieterich style bag holders.

The structure and operation of the direct vertical downward dispenser can now be set forth. As can be seen in FIG. 8, vertical dispenser 400 has a guide rail 402 along which a plurality of bag holders 410 are loaded. A large nib 408 at the bottom of guide rail 402 prevents the bag holders 410 from freely falling off the bottom of the dispenser's guide rail 402. The individual bag holders will tend to slightly spread or fan out at the bottom of the dispenser, enabling an operator to singly grasp and remove the individual bag holders. The loading of this dispenser 400 and the interlocking of the individual bag holders with the guide rail is similar to the embodiment as set out in FIGS. 2 to 6 above.

Figure 9:
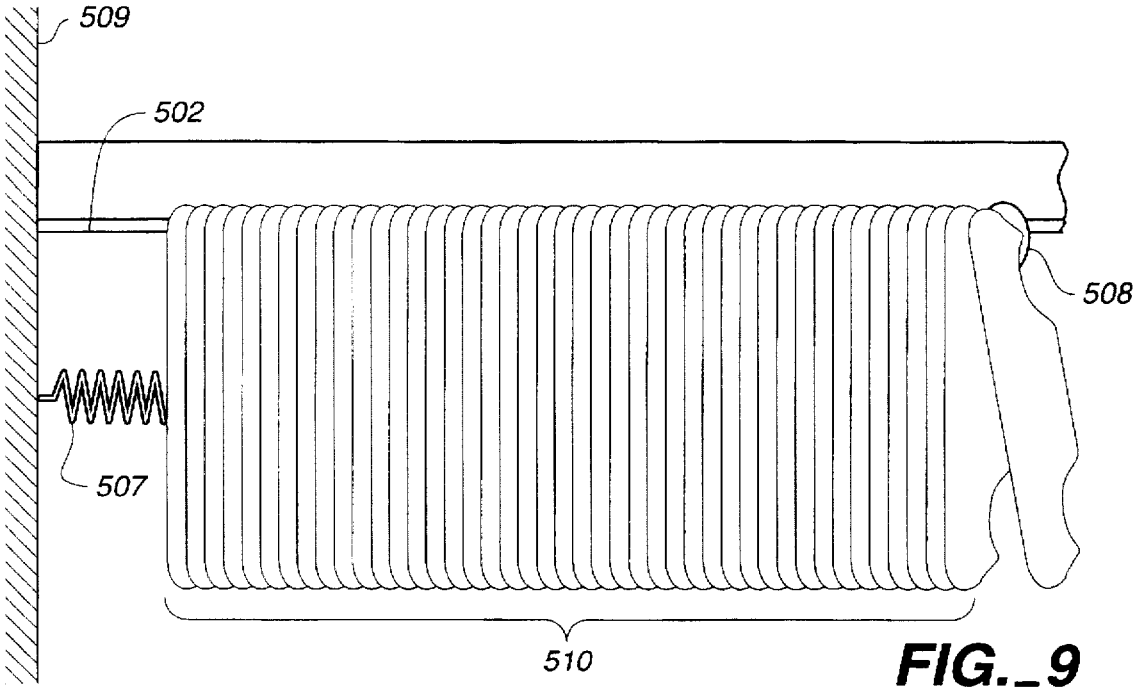
FIG. 9 is a side elevational view of another alternative dispenser for Dieterich style bag holders.

The structure and operation of the horizontally biased dispenser can now be set forth. As can be seen in FIG. 9, horizontal dispenser 500 has a guide rail 502 along which a plurality of bag holders 510 are loaded. Dispenser 500 is mounted against a substantially vertical wall 509. A large nib 508 at the end of guide rail 502 prevents the bag holders 510 from freely being pushed off the end of the dispenser's guide rail 502 by the action of spring 507. Nib 508 will also cause the bag holders 510 to spread apart slightly at this location, to aid in easy one by one removal of the bag holders. The individual bag holders will be presented at the end of the dispenser, enabling an operator to singly grasp and remove the individual bag holders. The interlocking nature of the individual bag holders with the guide rail is similar to the embodiment as set out in FIGS. 2 to 6 above.

Figure 10:
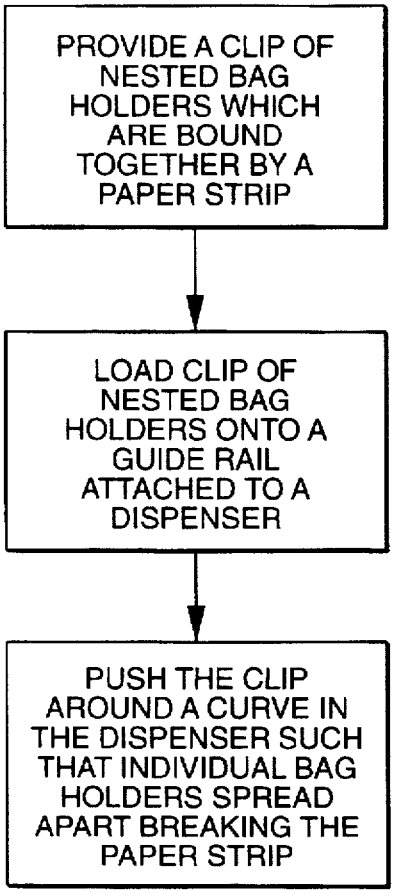
FIG. 10 shows the method of loading a dispenser with a clip of nested stack of bag holders and pushing said clip around a curve in said dispenser, thereby breaking a retaining strip holding said clip together.

FIG. 10 shows the method of loading a dispenser with a clip of nested stack of bag holders and pushing said clip around a curve in said dispenser, thereby breaking a retaining strip holding said clip together.

What is claimed is:

1. A dispenser for plastic bag strap holders, each holder having a main U-shaped section with a pair of T-shaped end receptacles formed by bendable opposed tabs forming the spanning of T-receptacles to receive and capture bag straps, comprising:

a) an elongated guide rail means for slidably mating with a mating receptacle of one end of each bag holder of a nested stack of said holders and for maintaining said stack in a single plane, b) said guide rail means having an infeed end and an outfeed end and having a substantial component of vertical orientation to cause said stack to feed by gravity from infeed to outfeed end, and said guide rail means being curved upwardly at said outfeed end, and c) stop means at said outfeed end for stopping movement of said nested stack and to allow one by one removal of each holder.

2. The dispenser as set out in claim 1 wherein, said guide rail means has a T-shaped cross section.

3. The dispenser as set out in claim 1 wherein, said guide rail means has a Y-shaped cross section.

4. The dispenser as set out in claim 1 wherein, said single plane is concurrent to the path through which said bag holders move from said infeed end to said outfeed end.

5. The dispenser as set out in claim 1 wherein, said T-shaped receptacle of a bag holder is formed from said opposed tabs being angled from a vertical orientation, wherein a bottom edge of said opposed tabs wraps around said guide rail means and a bottom side of said bag holder rests against said guide rail means.

6. The dispenser as set out in claim 1 wherein, said stop means comprises a nib, being formed of a substantial widening of said guide rail means.

7. The dispenser as set out in claim 1 wherein, said stop means comprises said guide rail means extending substantially upwards on the front of said dispenser.

8. The dispenser as set out in claim 1 wherein, said nested stack separates at curves along said guide rail dispensing member, causing a large gap to occur between individual bag holders in said stack at the ends of said individual bag holders farthest from said dispenser, thereby causing said nested stack to fan out whereby said one by one removal of said bag holders are facilitated.

9. The dispenser as set out in claim 8 wherein, said nested stack separates at a curve at said outfeed end.

10. The method of loading a dispenser with a nested stack of bag holders wherein said bag holders are bound together by a breakable retaining strip into a clip form, each bag holder having a T-shaped end receptacle formed by bendable opposed tabs forming leg of T-receptacle to receive and capture bag straps comprising of the steps of:

a) providing said clip of bag holders, b) subsequent to said holding step, loading said clip of bag holders onto said guide rail, wherein said receptacle mates with said guide rail, c) subsequent to said fitting step, pushing said clip around a curve in said dispenser, said curve causing said bag holders to spread apart, thus breaking said breakable retaining strip.

11. The method of loading the dispenser as set out in claim 8 where a clip of said bag holders, held together by a breakable retaining strip is provided, is loaded at an infeed end of said guide rail and then pushed around a curve in said guide rail such that said curve causes said bag holders to spread apart, thus breaking said breakable retaining strip, to allow said holders to naturally stack.

12. In combination a dispensing member and a plurality of stackable bag holders comprising:

a) a plurality of bag holders having an elongated body terminating in opposed ends, at least one of said opposed ends having a pair of bendable opposed tabs defining an end receptacle, said bag holders being formed to receive a second holder of substantially the same configuration in nested relation; and b) a dispensing member adapted to be suspended in vertically extending orientation, said dispensing member having an elongated guide rail means for slidably mating with an end receptacle of one of each bag holder in a nested stack of said bag holders, said elongated guide rail means having two ends, and one of said ends defining an outfeed end and being formed with a stop means for stopping movement of said nested stack, and said stop means further being formed to spread apart said nested stack at said stop means for one by one removal of said bag holders.

13. The dispenser as set out in claim 12 wherein, said guide rail means has a T-shaped cross section.

14. The dispenser as set out in claim 12 wherein, said guide rail means has a Y-shaped cross section.

15. The dispenser as set out in claim 12 wherein, said plurality of bag holders stack in a single plane which is concurrent to the path through which said bag holders move from said infeed end to said outfeed end.

16. The dispenser as set out in claim 12 wherein, said end receptacle of a bag holder is formed from said opposed tabs being angled from a vertical orientation, wherein a bottom edge of said opposed tabs wraps around said guide rail means and a bottom side of said bag holder rests against said guide rail means.

17. The dispenser as set our in claim 12 wherein, said stop means comprises a nib, being formed of a substantial widening of said guide rail means.

18. The dispenser as set out in claim 12 wherein, said stop means comprises said guide rail means extending substantially upwards on the front of said dispenser.

19. The dispensing member as set out in claim 12 wherein, said plurality of bag holders rests in a nested stack which separates at curves along said guide rail dispensing member, thereby causing a large gap to occur between individual bag holders in said stack at the ends of said individual bag holders farthest from said dispensing member, thereby causing said nested stack to fan out whereby said one by one removal of said bag holders are facilitated.

20. The dispenser as set out in claim 19 wherein, said nested stack separates at a curve at said outfeed end.

* * * * *